US007965965B2

(12) United States Patent
Maeda et al.

(10) Patent No.: US 7,965,965 B2
(45) Date of Patent: Jun. 21, 2011

(54) DEVELOPMENT DEVICE AND IMAGE FORMING APPARATUS

(75) Inventors: Masahiro Maeda, Matsumoto (JP); Yoichi Yamada, Shiojiri (JP); Yoshiyuki Kurebayashi, Shiojiri (JP); Daisuke Matsumoto, Matsumoto (JP); Masaru Kobashi, Matsumoto (JP); Takatomo Fukumoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/620,703

(22) Filed: Nov. 18, 2009

(65) Prior Publication Data

US 2010/0150619 A1 Jun. 17, 2010

(30) Foreign Application Priority Data

Dec. 11, 2008 (JP) ..... 2008-315585

(51) Int. Cl.
*G03G 15/08* (2006.01)

(52) U.S. Cl. ..... 399/286; 399/119; 492/31; 492/35

(58) Field of Classification Search ..... 399/119, 399/222, 252, 279, 281, 286, 287; 492/28, 492/30, 31, 33–36, 38
See application file for complete search history.

(56) References Cited

U.S. PATENT DOCUMENTS

| | | | | |
|---|---|---|---|---|
| 4,708,458 | A * | 11/1987 | Ueda et al. | 399/59 |
| 4,947,211 | A * | 8/1990 | Ono et al. | 399/105 |
| 5,812,917 | A * | 9/1998 | Iwata et al. | 399/281 |
| 2005/0207769 | A1 * | 9/2005 | Matsuda et al. | 399/53 |
| 2007/0110484 | A1 * | 5/2007 | Yamada et al. | 399/286 |

FOREIGN PATENT DOCUMENTS

| | | |
|---|---|---|
| JP | 2001-066876 | 3/2001 |
| JP | 2004-317541 | 11/2004 |
| JP | 2006-133369 | 5/2006 |
| JP | 2007-121947 | 5/2007 |
| JP | 2007-206144 | 8/2007 |

* cited by examiner

*Primary Examiner* — David P Porta
*Assistant Examiner* — Benjamin Schmitt
(74) *Attorney, Agent, or Firm* — Maschoff Gilmore & Israeisen

(57) ABSTRACT

Provided is a development device including: a development roller in which continuous spiraling inclined grooves having different inclinations with respect to an axial direction are formed so as to cross each other; and a feed roller which is in contact with the development roller and feeds toner to the development roller, wherein transportation force, which is used for transporting the toner on the development roller from one side to the other side of the axial direction of the development roller, is generated by the rotation of the feed roller.

10 Claims, 11 Drawing Sheets

DEVELOPMENT DEVICE AND IMAGE FORMING APPARATUS

BACKGROUND

1. Technical Field

The present invention relates to a development device and an image forming apparatus.

2. Related Art

In an image forming apparatus using non-magnetic one-component toner, the toner is charged with frictional electrification using a development roller. In order to efficiently generate frictional electrification, JP-A-2001-66876 discloses a development roller for allowing toner to be effectively rubbed against the development roller by performing a blast treatment with respect to the development roller and applying predetermined surface roughness Rz to the surface of the development roller.

However, the size, depth, shape and arrangement of the concave portions formed by the blast treatment are not uniform. Accordingly, since the toner which goes into a deep concave portion is not rolled, the toner may not be effectively charged. Filming may occur due to the unevenness of the irregularities of the surface of the development roller. If the toner is not effectively charged, toner may leak from a development device so as to be scattered in an image forming apparatus or fogging may occur in an image.

In order to improve the charging properties of the toner, JP-A-2007-121947 discloses a development roller, in which grooves are regularly arranged in a lattice shape by rolling, and a method of manufacturing the same. This development roller, in which the grooves are regularly formed, further improves the charging properties compared to a development roller having an irregular surface state by the blast treatment.

However, even in the development roller disclosed in JP-A-2007-121947, there is a filming with faint coloring. This filming is hereinafter referred to as "colored filming" because the filming grows as printing is repeated and the surface of the development roller is gradually appears to be dyed by the color of the toner. If the degree of colored filming becomes excessive, since the toner cannot be appropriately charged, the amount of scattered toner increases and fogging occurs in an image.

The cause of the colored filming is as follows. There are areas in which the toner cannot be sufficiently circulated in an inclined surface of a convex portion surrounded by the lattice-shaped grooves formed by rolling, and the toner is retained in those areas. When the temperature of the surface of the development roller increases during continuous printing, the retained toner is influenced by heat and filming gradually occurs. If the grooves are formed by rolling, a protrusion (hereinafter, referred to as "burr") may occur in the ridge line of the convex portion surrounded by the grooves. In a portion which is the shade of a burr, the toner is apt to be retained and filming is apt to occur.

The toner which is not developed and is left on the development roller is typically removed by a feed roller, and new toner is fed such that the same toner does not continuously stay at the same place. However, if the burr is present in the ridge line of the convex portion, as shown in FIGS. 16A and 16B, the old toner cannot be completely removed, regardless of the rotation direction of the feed roller. Accordingly, the toner is retained in the vicinity of the burr. As a result, the retained toner causes filming.

SUMMARY

An advantage of some aspects of the invention is that it provides a development device and an image forming apparatus, which are capable of preventing toner from being retained on a development roller and suppressing the occurrence of colored filming.

According to an aspect of the invention, there is provided a development device including: a development roller in which continuous spiraling inclined grooves having different inclinations with respect to an axial direction are formed so as to cross each other; and a feed roller which is in contact with the development roller and feeds toner to the development roller, wherein the transportation force, which is used for transporting the toner on the development roller from one side to the other side in the axial direction of the development roller, is generated by the rotation of the feed roller. By circulating the toner retained in the ridge lines of the convex portions surrounded by the crossing inclined grooves, it is possible to prevent toner from begin retained and suppress the occurrence of colored filming.

In the development device of the invention, the inclined grooves may be formed by rolling. Accordingly, it is possible to easily and reliably form the crossing inclined grooves.

In the development device of the invention, burrs may be formed in ridge lines of two sides of rectangular convex portions surrounded by the crossing inclined grooves. Even when burrs are formed, by generating the transportation force in the axial direction, it is possible to extrude and circulate the toner retained in the shade portions of the burrs.

In the development device of the invention, the two sides of the convex portions, in which the burrs are formed, may be a side opposed to the direction of the transportation force. By forming burrs only on the side opposed to the direction of the transportation force, it is possible to more reliably circulate the toner retained in the shade portions of the burrs.

In the development device of the invention, the feed roller may be a brush roller obtained by spirally winding a basic material having a plurality of brush bristles transplanted thereon on the outer circumference of a core, and the transportation force for transporting the toner from one side to the other side in the axial direction of the development roller may be generated by a direction of a winding seam formed by the winding of the brush roller. It is possible to configure the feed roller to generate the toner transportation force on the development roller with a simple configuration.

In the development device of the invention, the circumferential velocity of the feed roller may be more than that of the development roller. It is possible to efficiently generate the transportation force.

In the development device of the invention, the axial direction of the feed roller may be disposed to be skewed with respect to the axial direction of the development roller, and the transportation force for transporting the toner from one side to the other side in the axial direction of the development roller may be generated by the rotation of the feed roller. It is possible to generate the toner transportation force on the development roller with a simple configuration.

In the development device of the invention, the feed roller may be formed of an elastic foam material. It is possible to form the feed roller using an easily available material.

In the development device of the invention, the development roller and the feed roller may be driven by gears. By driving using the gears, reactive force may be generated in the skewed feed roller, and the reactive force may generate the toner transportation force on the development roller.

In the development device of the invention, the position of a bearing of the feed roller may be changeable. It is possible to simply skew the feed roller.

In the development device of the invention, the circumferential velocity of the feed roller may be more than that of the development roller. It is possible to efficiently generate the transportation force.

According to another aspect of the invention, there is provided an image forming apparatus including: a latent image carrier on which an electrostatic latent image is formed; a development device which develops the electrostatic latent image using toner and develops a toner image on the latent image carrier; and a transfer device which transfers the toner image of the latent image carrier onto a transfer medium, wherein the development device is the above-described development device. It is possible to prevent toner on the development roller from being retained and suppress the occurrence of colored filming. Thus, it is possible to obtain a high quality image.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
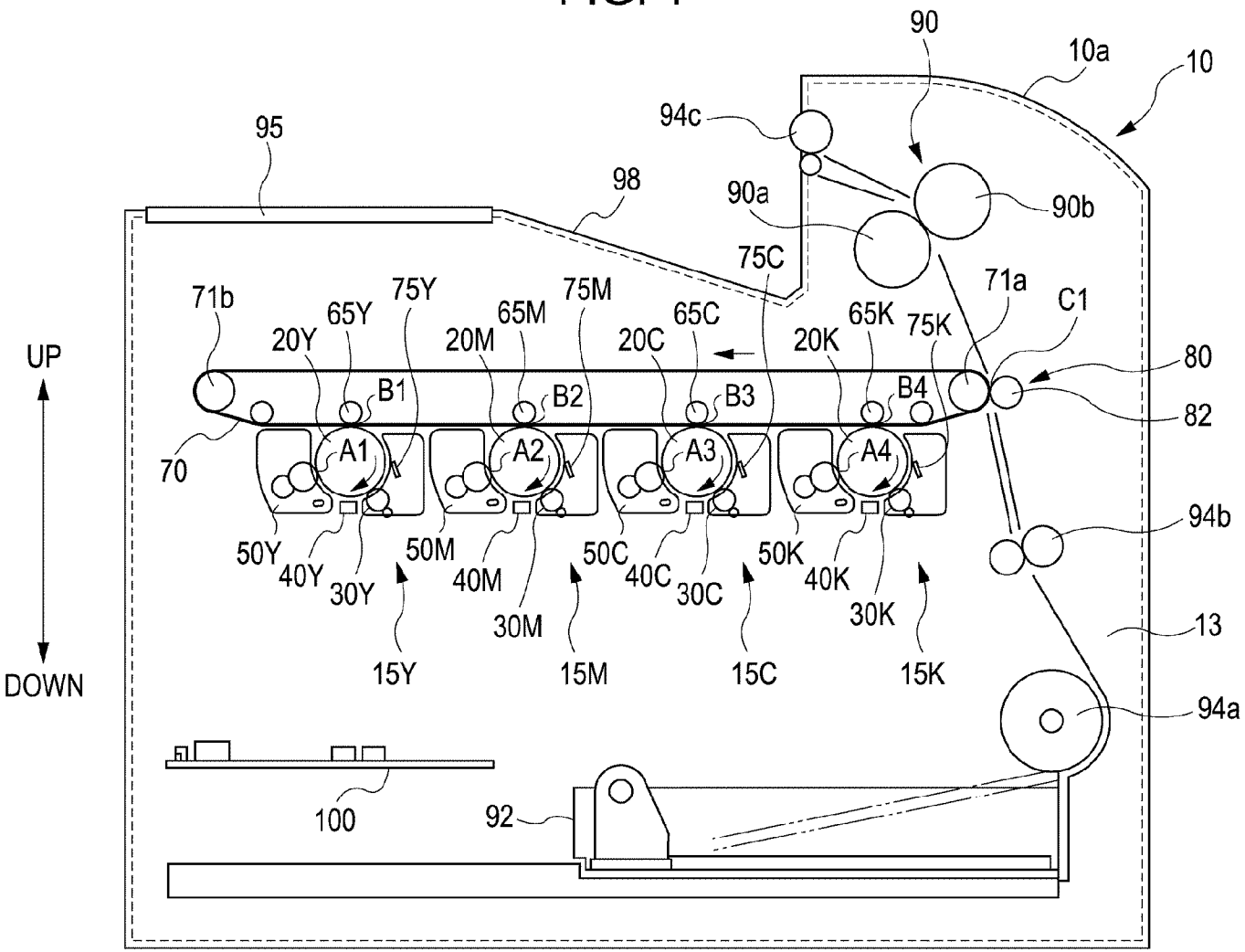
FIG. 1 is a view showing the overall configuration of an image forming apparatus according to an embodiment of the invention.

Hereinafter, the embodiments of the invention will be described with reference to the accompanying drawings. FIG. 1 is a schematic view showing an image forming apparatus according to an embodiment of the invention.

As shown in FIG. 1, an image forming apparatus 10 includes four image forming stations 15 (Y, M, C, K), an intermediate transfer belt 70, and a secondary transfer unit 80, and further includes a fixing unit 90, a display unit 95 functioning as a reporting unit to a user and including a liquid crystal panel, and a control unit 100 for controlling the above-described units and performing an operation of the image forming apparatus. The image forming stations 15 (Y, M, C, K) have functions for forming images respectively using yellow (Y), magenta (M), cyan (C) and black (K) toner. The configurations of the image forming stations 15 (Y, M, C, K) are the same, hereinafter, only the image forming station 15Y will be described.

As shown in FIG. 1, the image forming station 15Y has a charging unit 30Y, an exposure unit 40Y, a development unit 50Y, and a primary transfer unit along the rotation direction of a photosensitive body 20Y which is an example of an image carrier.

The photosensitive body 20Y has a cylindrical basic material and a photosensitive layer formed on the outer circumferential surface thereof, can rotate around a central axis, and, in the present embodiment, rotates in a clockwise direction as denoted by an arrow.

The charging unit 30Y is a device for charging the photosensitive body 20Y. The exposure unit 40Y irradiates a laser so as to form a latent image on the charged photosensitive body 20Y.

The exposure unit 40Y has a semiconductor laser, a polygon mirror, an F-θ lens and the like, and irradiates a modulated laser onto the charged photosensitive body 20Y based on an image signal received from a host computer (not shown) such as a personal computer, a word processor or the like.

The development unit 50Y is a device for developing the latent image formed on the photosensitive body 20Y using yellow (Y) toner. In the development unit 50Y, a development roller 51Y and a feed roller 52Y are disposed in a development chamber to which toner is fed from a replaceable toner cartridge, and a regulation blade 53Y is in contact with the development roller 51Y so as to create a thin layer of toner on the development roller 51Y.

In the primary transfer unit, a primary transfer bias is applied by a primary transfer roller 65Y at a primary transfer portion B1 such that a yellow toner image formed on the photosensitive body 20Y is transferred onto the intermediate transfer belt 70. When the toners of four colors are sequentially and repeatedly transferred at the primary transfer portions B1, B2, B3 and B4, a full-color toner image is formed on the intermediate transfer belt 70.

The intermediate transfer belt 70 is an endless belt stretched over a belt driving roller 71*a* and a driven roller 71*b* and is rotated while being in contact with the photosensitive bodies 20 (Y, M, C, K).

The secondary transfer unit 80 is a device for transferring a single-color toner image or a full-color toner image formed on the intermediate transfer belt 70 onto a transfer material such as paper, film or cloth, or the like.

The fixing unit 90 includes a fixing roller 90*a* and a pressurizing roller 90*b* and is a device for fusing the single-color toner image or the full-color toner image transferred onto the transfer material on the transfer material so as to form a permanent image.

Next, the operation of the image forming apparatus 10 will be described. First, when an image signal and a control signal from the host computer (not shown) is input to a main controller of the image forming apparatus via an interface, the photosensitive body 20Y, the development roller 51Y included in the development unit 50Y, the intermediate transfer belt 70 and the like are rotated under the control of a unit controller based on an instruction from this main controller. The photosensitive body 20Y is sequentially charged by the charging unit 30Y at a charging position while rotating.

A charged region of the photosensitive body 20Y reaches an exposure position due to the rotation of the photosensitive body 20Y and the latent image according to the image information of yellow Y is formed in this region by the exposure unit 40Y. The latent image formed on the photosensitive body 20Y reaches a development position due to the rotation of the photosensitive body 20Y so as to be developed by the development unit 50Y. Accordingly, the toner image is formed on the photosensitive body 20Y.

The toner image formed on the photosensitive body 20Y reaches the position of the primary transfer portion B1 by the rotation of the photosensitive body 20Y so as to be transferred onto the intermediate transfer belt 70 by the primary transfer unit. At this time, in the primary transfer unit, a primary transfer voltage with a polarity opposed to the charging polarity of the toner is applied from the primary transfer roller 65Y. As a result, the four-color toner images formed on the photosensitive bodies 20 (Y, M, C, K) are transferred onto the intermediate transfer belt 70 so as to overlap with each other such that the full-color toner image is formed on the intermediate transfer belt 70.

The intermediate transfer belt 70 is driven by transferring the driving force from a belt driving unit such as a motor through a belt driving roller 71*a*.

The full-color toner image formed on the intermediate transfer belt 70 is transferred onto the transfer material such as paper by the secondary transfer unit 80. Such a transfer material is transported from a paper feed tray to the secondary transfer unit 80 via a paper feed roller 94*a* and a registration roller 94*b*.

The full-color toner image transferred onto the transfer material is heated and pressurized by the fixing unit 90 and fused onto the transfer material. After passing through the fixing unit 90, the transfer material is ejected by an ejection roller 94*c*.

Meanwhile, the photosensitive bodies 20 (Y, M, C, K) are neutralized by a neutralization unit (not shown) after passing through the positions of the primary transfer portions B1, B2, B3 and B4 and prepared for charging in order to form a next latent image.

An intermediate transfer belt cleaning device (not shown) is provided on the side of the driven roller 71*b* of the intermediate transfer belt 70 after the secondary transfer so as to clean the intermediate transfer belt 70 after the secondary transfer.

Figure 2A:
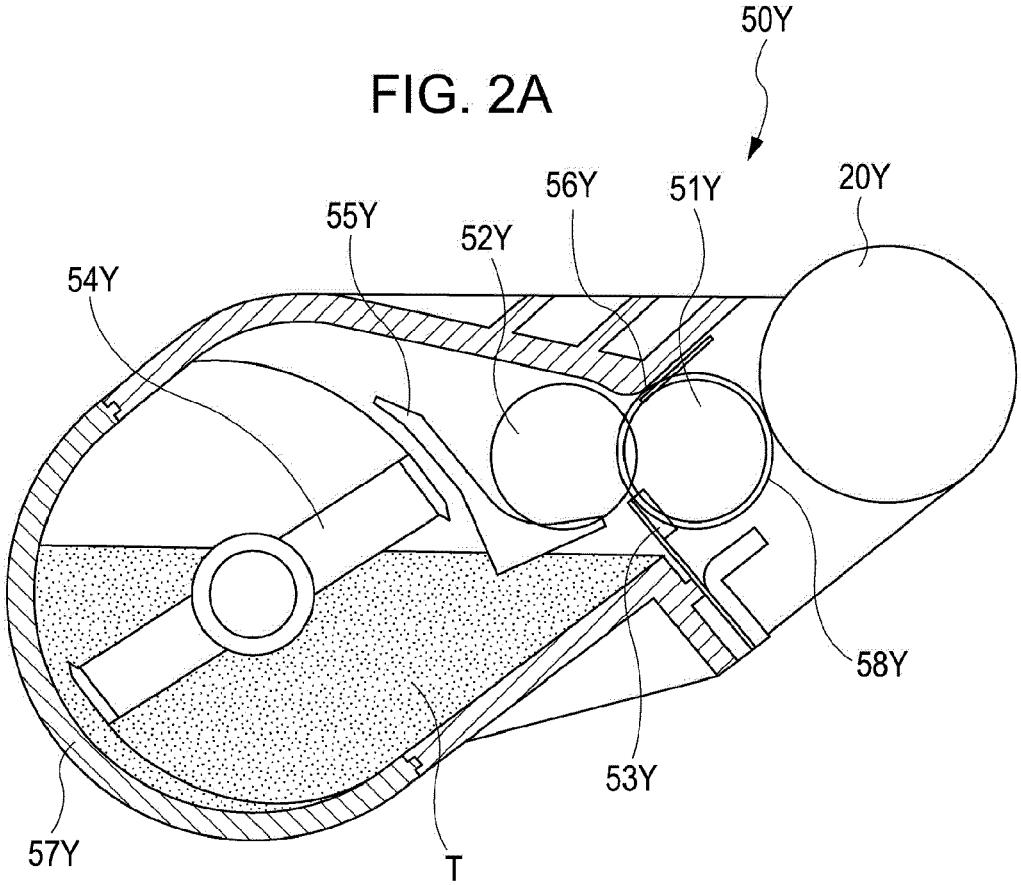
FIGS. 2A and 2B are views showing an example of a development device according to the invention.
Figure 2B:
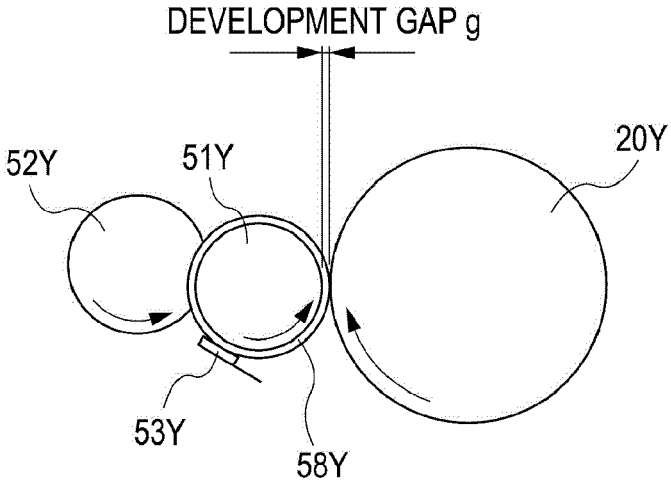

FIG. 2A is a schematic view showing an example of the development unit 50Y of the invention, and FIG. 2B is a partial view of the development unit 50Y of this example.

The development unit 50Y includes a development roller 51Y for transporting a toner T to a photosensitive body 20Y, a feed roller 52Y pressed into contact with the development roller 51Y so as to feed the toner T, a regulation blade 53Y pressed into contact with the development roller 51Y so as to regulate the toner T transported to the photosensitive body 20Y, a toner stirring/transporting member 54Y for stirring and transporting the toner T, a toner receiving member 55Y for receiving the toner T transported by the toner stirring/transporting member 54Y and guiding the toner toward the feed roller 52Y, a seal member 56Y for preventing toner leakage while being in contact with the development roller 51Y in such a direction so as to collect the toner T retained after development, and a case 57Y for receiving the toner T.

The development roller 51Y is formed of a conductive material such as a metal which may include copper, aluminum or stainless steel or an alloy thereof in a cylindrical shape. The feed roller 52Y is formed of an elastic material such as urethane foam rubber, silicon rubber or the like in a cylindrical shape or is formed by winding a transplanted sheet on a cylindrical core. By rotating the development roller 51Y and the feed roller 52Y while being in contact with each other, the toner T is fed onto the development roller 51Y and a toner layer with a predetermined thickness is formed on the development roller 51Y. The regulation blade 53Y is brought into contact with the development roller 51Y, to which the toner T is fed, so as to regulate the thickness of the toner layer on the development roller 51Y. The toner particles on the development roller 51Y are charged by frictional electrification.

Spacers 58Y are fixed to both ends of the development roller 51Y. The spacers 58Y are pressed into contact with an image non-carrying surface of the photosensitive body 20Y such that a development gap g is formed between a toner transportation surface of the development roller 51Y and an image carrying surface of the photosensitive body 20Y opposed to the toner transportation surface.

The development gap g is adjusted to a desired size by appropriately selecting the thickness of the spacers 58Y. Accordingly, the development device performs a non-magnetic one-component developer non-contact jumping development using the toner T which is a non-magnetic one-component developer. In this case, in this example, as shown in FIG. 2B, the photosensitive body 20Y rotates in a clockwise direction and the development roller 51Y and the feed roller 52Y rotates in a counterclockwise direction. The circumferential velocity of the photosensitive body 20Y and the circumferential velocity of the spacers 58Y on the development roller 51Y are set to be equal or substantially equal. In addition, although a non-contact type development method is described in the present embodiment, a contact type development method may be used.

Figure 3:
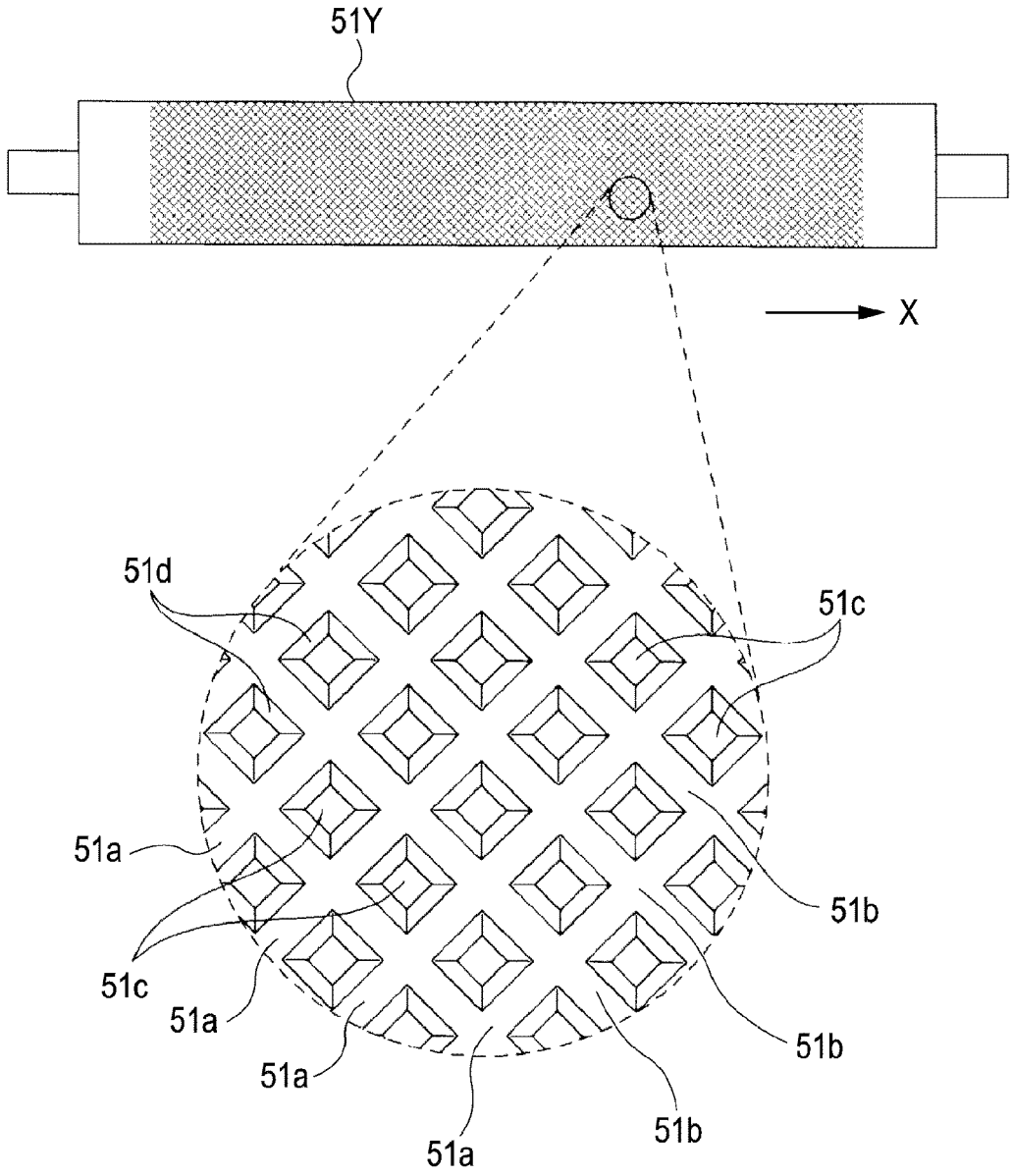
FIG. 3 is a view showing a development roller according to the invention and an example of a partial enlarged view of the surface thereof.

FIG. 3 is a view showing a development roller according to the invention and an example of a partial enlarged view of the surface thereof. The partial enlarged view (in a dotted circle) of FIG. 3 is an enlarged view of the surface of the development roller 51Y.

In order to improve the transportation properties of the toner and the charging properties of the toner, continuous spiraling first inclined groove 51*a* inclined at a predetermined angle with an axial direction and continuous spiraling second inclined grooves 51*b* inclined in a direction opposed to the first inclined grooves 51*a* are formed in the surface of the development roller 51Y so as to cross each other. Rectangular convex portion 51*c* each having inclined side surfaces 51*d* are formed so as to be surrounded by the first inclined grooves 51*a* and the second inclined grooves 51*b*. In the development roller 51Y of the invention, a regulation method is employed for transporting the toner mainly in the groove portions of the first inclined grooves 51*a* and the second inclined grooves 51*b* formed in the surface thereof. Since the development roller 51Y is formed of a conductive material such as a metal which may include copper, aluminum or stainless steel or an alloy thereof, image mirror force acts with the charged toner transported in the groove and the toner is stably transported to a development nip. If a small particle diameter toner with a volume average particle size of 5 μm or less is used as the toner, it is possible to improve the quality of the image. In addition, since the small particle diameter toner is able to be highly charged compared to a large particle diameter toner, it is suitable for the regulation method for transporting the toner mainly in the groove. The surface of the development roller 51Y may be subjected to nickel plating, chromium plating or the like, if necessary. A toner having an average circularity of 0.95 to 0.99 and preferably 0.972 to 0.983 is used as the toner. Accordingly, a charging amount is stabilized and transportation properties are excellent. As a method of adjusting the toner circularity, in an emulsion polymerization method, the circularity can be freely changed by controlling the temperature and time of a process for aggregating secondary particles, and the range thereof may be set to 0.94 to 1.00. In a suspension polymerization method, a spherical toner can be prepared and the circularity may be in a range of 0.98 to 1.00. The average circularity can be suitably adjusted to 0.95 to 0.99 by heating and deforming the toner at a Tg temperature or more.

Figure 4:
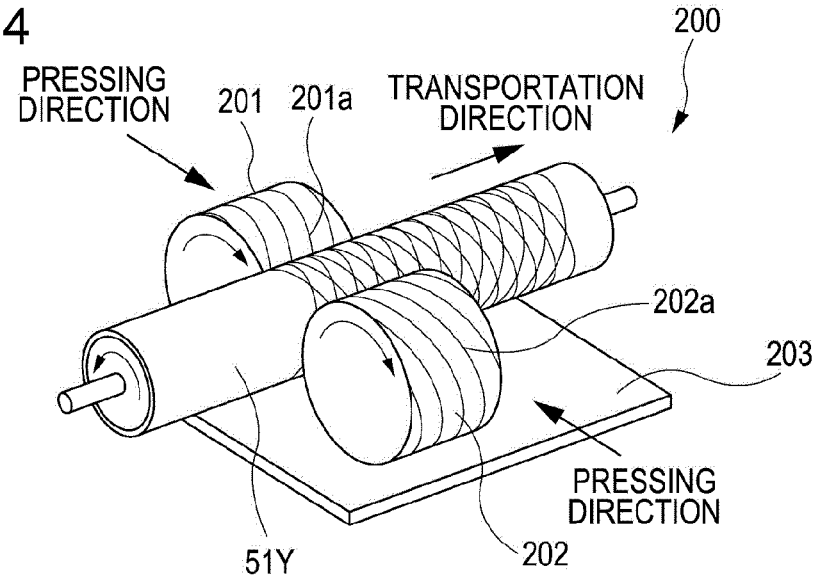
FIG. 4 is a view showing an example of a rolling device.

FIG. 4 is a view showing an example of a rolling device 200 used for a rolling process to form the first inclined grooves 51*a* and the second inclined grooves 51*b* in the surface of the development roller 51Y.

The rolling device 200 includes a first die 201 including a first inclined cutting edge 201*a* for forming the first inclined grooves 51*a* in the development roller 51Y, a second die 202 including a second inclined cutting edge 202*a* for forming the second inclined grooves 51*b* in the development roller 51Y, and a guide stage 203 disposed below the first die 201 and the second die 202.

The rolling device 200 transports a work piece (here, a non-rolled development roller 51Y) among the first die 201 and the second die 202, which are disposed at opposed positions and are rotated in the clockwise direction as denoted by arrows, and the guide stage 203 so as to perform rolling. During rolling, working pressure is applied in a direction for pressing the first die 201 and the second die 202 to the non-rolled development roller 51Y. The non-rolled development roller 51Y is rotated in the counterclockwise direction opposed to the rotation direction of the first die 201 and the second die 202 so as to perform rolling.

The first inclined cutting edge 201*a* and the second inclined cutting edge 202*a* for forming the first inclined grooves 51*a* and the second inclined grooves 51*b* are respectively provided in the first die 201 and the second die 202. The first inclined cutting edge 201*a* and the second inclined cutting edge 202*a* form the crossing first and second inclined grooves 51*a* and 51*b* and a truncated-prismoid-shaped convex portions 51*c* having the inclined side surfaces 51*d* in the surface of the non-rolled development roller 51Y.

The shape of the truncated-prismoid-shaped convex portions 51*c* is a square shape if the inclined angles of the first and second inclined grooves 51*a* and 51*b* are set to 45° and the pitches between the grooves is set to be equal, or is a rhombic shape if the inclined angles of the first and second inclined grooves 51*a* and 51*b* are set to an angle other than 45° and the pitches between the grooves are set to be equal. The shape of the rectangular convex portions 51*c* is a rectangular shape if the inclined angles of the first and second inclined grooves 51*a* and 51*b* are set to 45° and the pitches between the grooves are set to be different or is a parallelogram shape if the inclined angles of the first and second inclined grooves 51*a* and 51*b* are set to an angle other than 45° and the pitches between the grooves are set to be different. Since burrs 51*e* are formed in the ridge lines of the rectangular convex portions 51*c*, the shape of the convex portions 51*c* is a square shape in order to reduce the length of the ridge line. Accordingly, the pitches between the first and second inclined grooves 51*a* and 51*b* are set to be equal such that the crossing angle becomes 90°.

Although the portions in which the first die 201 and the second die 202 are brought into contact with the surface of the non-rolled development roller 51Y are the first inclined cutting edge 201*a* and the second inclined cutting edge 202*a*, the first inclined cutting edge 201*a* and the second inclined cutting edge 202*a* do not cut actively the work piece in rolling, but crush the work piece by a pressing force so as to form dents.

During rolling, the first die 201 and the second die 202 are not brought into contact with both ends of the non-rolled development roller 51Y such that smooth surfaces without irregularities are left at both ends. That is, the convex portions 51*c* which are not in contact with the first die 201 and the second die 202 on the central portion of the development roller 51Y and both ends, which are not subjected to rolling, become nonworked surfaces.

Figure 16A:
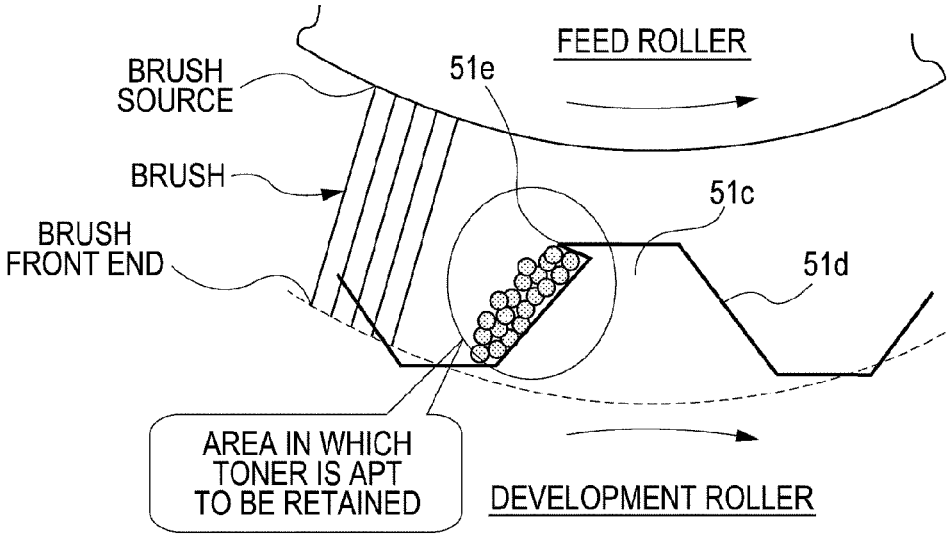
FIG. 16A PRIOR ART
FIGS. 16A and 16B are view showing retention of toner due to burr.
Figure 16B:
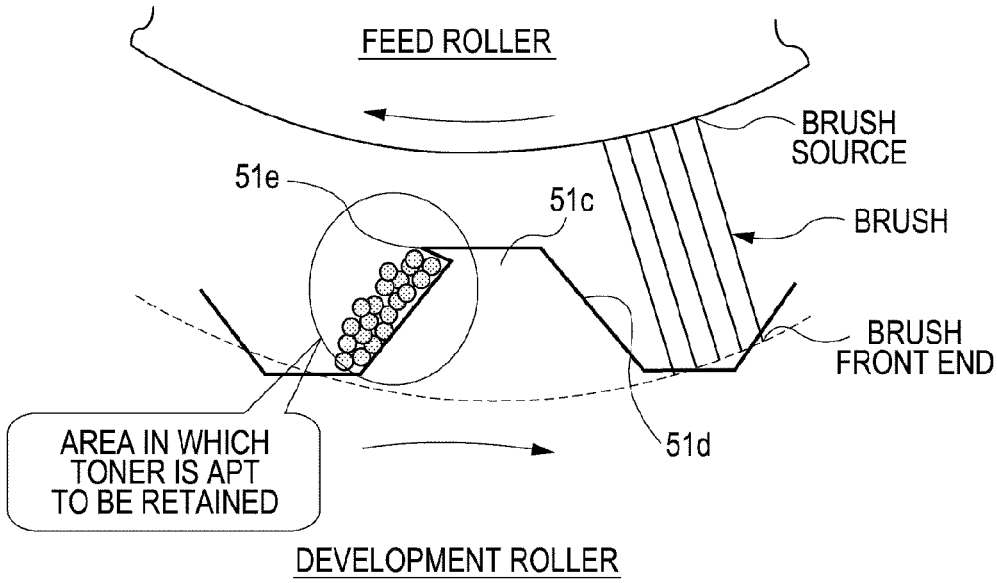
FIG. 16B PRIOR ART

Even when the development roller 51Y in which regular grooves are formed is used, an area in which the toner cannot be sufficiently circulated is present in the inclined side surfaces 51*d* of the truncated-prismoid-shaped convex portions 51*c* surrounded by the first inclined grooves 51*a* and the second inclined grooves 51*b* of the development roller 51Y, the toner is retained in that portion, and the above-described colored filming occurs. As the area in which the toner is not sufficiently circulated, as shown in FIGS. 16A and 16B, there are the inclined side surfaces 51*d* of the convex portions 51*c* located on the shade of the burrs 51*e* which are formed in the rolling process.

Figure 5:
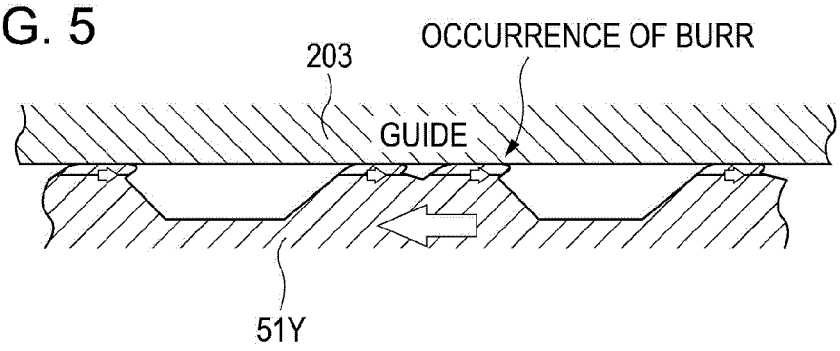
FIG. 5 is a view showing a burr generation mechanism.

In rolling, the first inclined cutting edge 201*a* of the first die 201 and the second inclined cutting edge 202*a* of the second die 202 do not actively cut the work piece, but crush the work piece by a pressing force so as to form dents. Accordingly, as shown in FIG. 5, swollen portions are formed on the ridge lines of the truncated-prismoid-shaped convex portions 51*c* surrounded by the first inclined grooves 51*a* and the second inclined grooves 51*b* formed after rolling, the swollen portions formed on the ridges lines of two sides located at the upstream side of the rotation direction (the rear side of the rotation direction) during rolling of the work piece are crushed by the guide stage 203, and the burrs 51*e* protruding outward from the ridge lines (from the ridge lines of the convex portions 51*c* to the upstream side of the rotation direction during rolling of the non-rolled development roller 51Y) are formed. The swollen portions are formed on the ridge lines of the downstream side of the rotation direction (the front side of the rotation direction), but the swollen portions of the downstream side are crushed on the upper surfaces of the convex portions 51*c* and thus do not protrude to the outside of the ridge lines.

Figure 6:
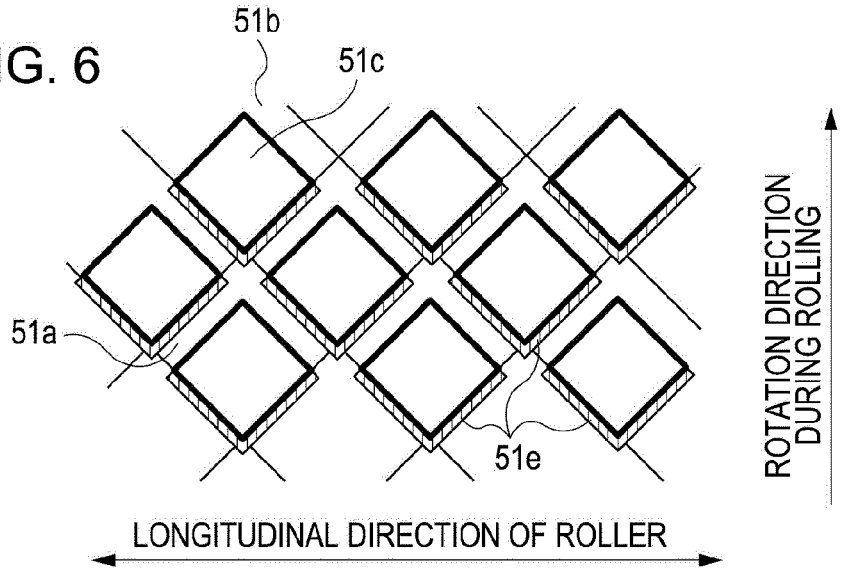
FIG. 6 is a view showing the positions of burrs and crossing inclined grooves formed by the rolling device of FIG. 4.

FIG. 6 is a view showing places where the burrs 51*e* are formed when the development roller 51Y is rolled by the rolling device of FIG. 4.

As shown in FIG. 6, the burrs 51*e* are formed in the ridge lines of two sides of the truncated-prismoid-shaped convex portions 51*c* surrounded by the first inclined grooves 51*a* and the second inclined grooves 51*b*. The ridge lines of the two sides, in which the burrs 51*e* are formed, face one side (right side) and the other side (left side) in the axial direction of the development roller 51Y. In the rolling process 200 shown in FIG. 4, when rolling is performed in a state in which the rotation direction of the first die 201 and the second die 202 are set to the counterclockwise direction and the rotation direction of the non-rolled development roller 51Y is set to the clockwise direction, the ridge lines of the two sides, in which the burrs 51*e* are formed, are changed. However, the ridge lines of the two sides, in which the burrs 51*e* are formed, face one side (right side) and the other side (left side) in the axial direction of the development roller 51Y. In the rolling process to form the inclined grooves in the development roller 51Y, if the first inclined grooves 51*a* and the second inclined grooves 51*b* are simultaneously formed, the ridge lines of the two sides, in which the burrs 51*e* are formed, are formed so as to face one side (right side) and the other side (left side) of the axial direction of the development roller 51Y, respectively.

The burrs 51*e* cause the retention of the toner and cause colored filming. It was found by experiments that it is efficient that the flow of the toner in the axial direction toward the ridge lines, in which the burrs 51*e* are formed, is formed in the development roller 51Y, in order to circulate the toner retained on the inclined side surfaces 51*d* of the convex portions 51*c* which are in the shade of the burrs 51*e*.

Figure 7:
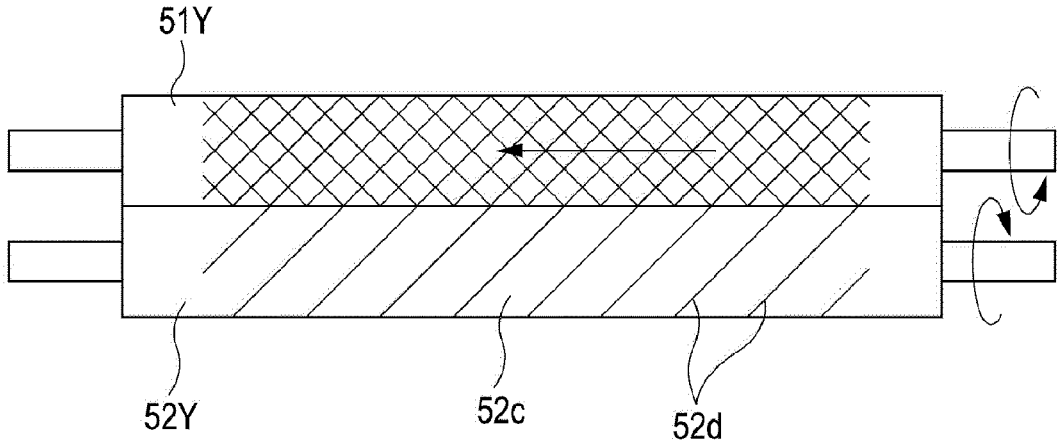
FIG. 7 is a view showing a first embodiment of the generation of the toner transportation force in an axial direction in the development roller.
Figure 8A:
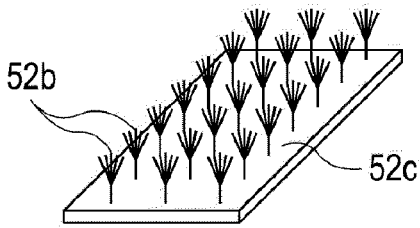
FIGS. 8A and 8B are views showing a process of manufacturing a feed roller according to the first embodiment.
Figure 8B:
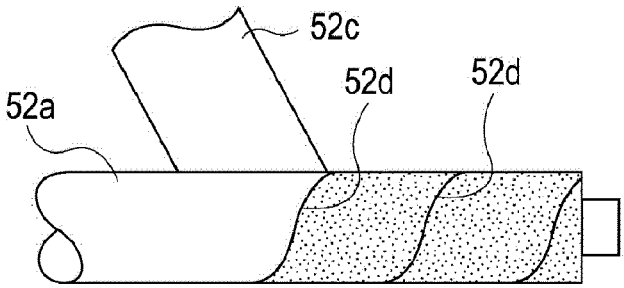

FIG. 7 is a view showing a first embodiment of the feed roller 52Y used for generating transportation force for transporting the toner on the development roller 51Y from one side to the other side in the axial direction of the development roller 51Y. FIGS. 8A and 8B are views showing a process of manufacturing the feed roller 52Y of the first embodiment.

The feed roller 52Y of the first embodiment is a brush roller obtained by spirally winding a ribbon-like basic material 52*c* formed of a material such as cloth, on which soft elastic brush bristles 52*b* made of nylon are transplanted, on the outer circumferential surface of a core 52*a* made of iron and with a diameter of ϕ8 mm. If the brush bristles 52*b* are transplanted nearly up to both ends of the ribbon-like basic material 52*c*, the brush bristles 52*b* are apt to fall off. Accordingly, generally, the brush bristles 52*b* cannot be transplanted in the vicinity of both ends of the ribbon-like basic material 52*c*. Therefore, the brush bristles 52*b* are not present or the density of the brush bristles is low in the portion of a winding seam 52*d* of the ribbon-like basic material 52*c* spirally wound on the outer circumferential surface of the core 52*a*.

The feed roller 52Y, which is formed by spirally winding the ribbon-like basic material 52*c* with the brush bristles 52*b* transplanted thereon on the outer circumferential surface of the core 52*a*, is brought into contact with the surface of the development roller 51Y in which the crossing inclined grooves 51*a* and 51*b* are formed and are rotated in the direction opposed to the rotation direction of the development roller 51Y such that toner is fed to the development roller. Since the spiral winding seam 52*d* in which the brush bristles 52*b* are not present or the density of the brush bristles is low is formed in the feed roller 52Y, by the rotation of the feed roller 52Y, the transportation force is generated for transporting the toner fed to the development roller 51Y from one side to the other side in the axial direction of the development roller 51Y along the direction of the spiral winding seam 52*d*.

By the generation of the toner transportation force on the development roller 51Y by the rotation of the feed roller 52Y, the toner, which is retained without being circulated in the shade portions of the burr 51*e* formed on the side opposed to the direction of the transportation force of the development roller 51Y, is pushed out and circulated by the introduction of the toner with the transportation force into the shade portions of the burrs 51*e*.

The width of the bristles of the feed roller 52Y is 298 mm. The width of the bristles of the feed roller 52Y substantially coincides with the width of the toner carrying surface in which the crossing inclined grooves of the development roller 51Y are formed. The length of the brush bristles 52*b* (the height of the bristles) in a free state is 6 mm, and thus the outer diameter of the feed roller 52Y is ϕ20 mm. The thickness of the brush bristles 52*b* is 330 tex. The distance between the axes of the feed roller 52Y and the development roller 51Y is 17.5 mm and thus a bite amount of the brush bristles 52*b* to the development roller 51Y is 1.5 mm. At this time, the deformation amount of the axial direction of the brush bristles 52*b* located on both ends of the feed roller 52Y is a maximum of 3.97 mm.

In the first embodiment, by setting the circumferential velocity of the feed roller 52Y to be higher than that of the development roller 51Y, the toner transportation force on the development roller is remarkably increased, the toner retained without being circulated is efficiently circulated, toner is prevented from being retained, and the occurrence of colored filming is suppressed. In order to generate a difference in circumferential velocity, a gear ratio is changed if the development roller 51Y and the feed roller 52Y are driven by gears and pulse control is performed if the rollers are driven by pulse motors.

Figure 9A:
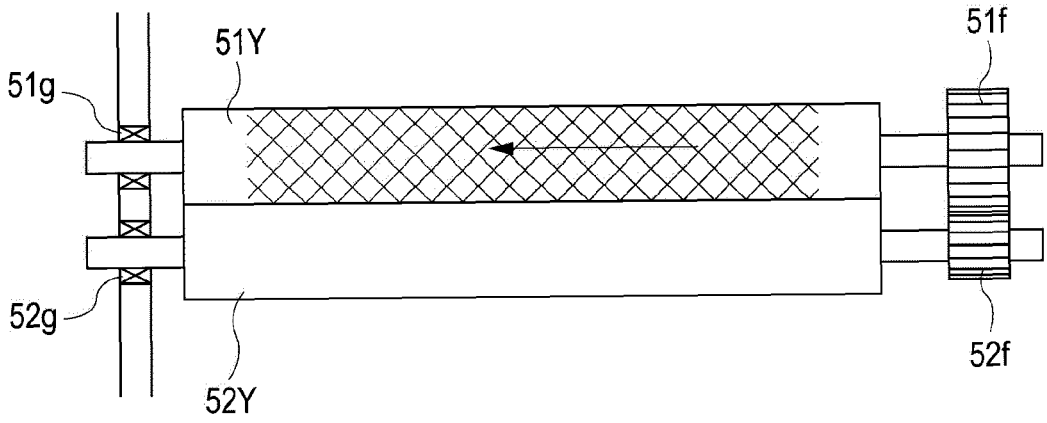
FIGS. 9A, 9B and 9C are views showing a second embodiment of the generation of the toner transportation force in the axial direction in the development roller.
Figure 9B:
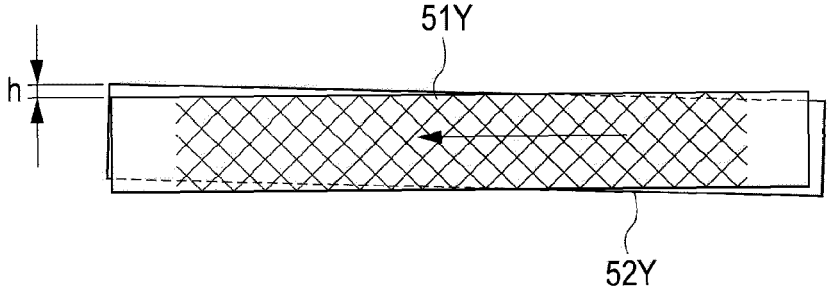
Figure 9C:
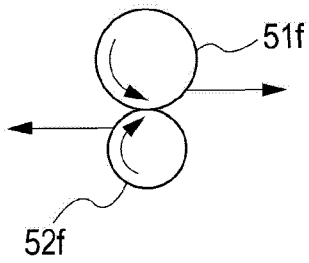

FIGS. 9A, 9B and 9C are views showing a second embodiment of the feed roller 52Y for generating the transportation force for transporting the toner on the development roller from one side to the other side of the axial direction of the development roller 51Y.

The feed roller 52Y of the second embodiment is formed of an elastic porous foam material (elastic foam material) manufactured by a slab foaming method. As the elastic foam material, for example, there is urethane foam, foamed polyurethane, or the like.

A gear 51*f* for delivering driving force from a driving sources is disposed on one end of the development roller 51Y, the gear 51*f* is engaged with a gear 52*f* disposed on one end of the feed roller 52Y, the feed roller 52Y is rotated in the opposite direction of the development roller 51Y. The other end of the development roller 51Y is pivoted on a bearing 51*g*. The other end of the feed roller 52Y is pivoted on a bearing 52*g*. The bearing 52*g* of the feed roller 52Y is movably disposed along a long hole or a plurality of bearing holes is provided such that the bearing position is changed.

By the changing the bearing position of the feed roller 52Y, the axial direction of the feed roller 52Y is skewed with respect to the axial direction of the development roller 51Y. By skewing the axial direction of the feed roller 52Y with respect to the axial direction of the development roller 51Y, as shown in FIG. 9, reactive force denoted by an arrow is generated in the gear 51*f* of the development roller 51Y and the gear 52*f* of the feed roller 52Y. Due to the reactive force generated by the skewed engagement between the gear 51*f* of the development roller 51Y and the gear 52*f* of the feed roller 52Y, the transportation force is generated for transporting the toner on the development roller, which is in contact with the rotating feed roller 52Y, from one side to the other side in the axial direction of the development roller 51Y.

By the generation of the toner transportation force on the development roller 51Y by the rotation of the feed roller 52Y, the toner, which is retained without being circulated in the shade portions of the burrs 51*e* formed on the side opposed to the direction of the transportation force of the development roller 51Y, is pushed out and circulated by the introduction of the toner with the transportation force into the shade portions of the burrs 51*e*.

The outer diameter of the development roller 51Y was ϕ18 mm, the outer diameter of the feed roller 52Y was ϕ19 mm, and the skew amount h was 500 μm.

In the second embodiment, by setting the circumferential velocity of the feed roller 52Y to be higher than that of the development roller 51Y, the toner transportation force on the development roller is remarkably increased, the toner retained without being circulated is efficiently circulated, the toner is prevented from being retained, and the occurrence of colored filming is suppressed. A difference in circumferential velocity is generated by changing a gear ratio.

Figure 10:
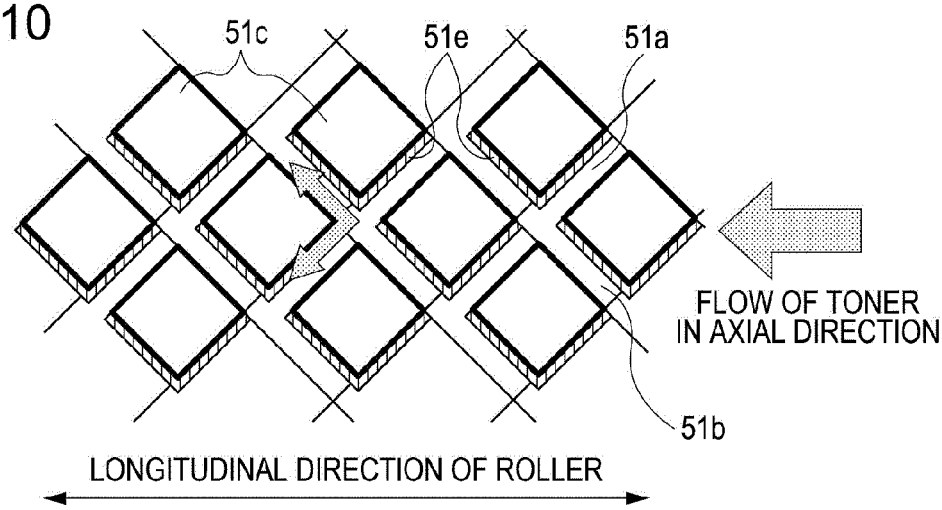
FIG. 10 is a view showing the operation and the effect when the transportation force of the axial direction is generated in the development roller formed by rolling shown in FIG. 4.

FIG. 10 is a view showing the flow of the toner when the transportation force by the feed roller of the first embodiment or the second embodiment is generated in the development roller 51Y in which the burrs 51*e* are formed in the ridge lines of the two sides opposed to one side (right side) and the other side (left side) of the axial direction of the development roller 51Y formed by rolling shown in FIG. 4.

By the toner transportation force of the axial direction generated in the development roller 51Y, the toner, which is retained without being circulated in the shade portions of the burrs 51*e* of one side formed on the side opposed to the transportation force, is pushed out and circulated by the introduction of the toner with the transportation force into the shade portions of the burrs 51*e*. The toner retained in the burrs 51*e* formed in one side which is not opposed to the transportation force of the toner does not receive the benefit of the circulation of the toner due to the transportation force, but the toner retained in the burr 51*e* of at least one side may be circulated. As a result, the amount of toner being retained on the development roller 51Y is reduced such that the occurrence of colored filming is suppressed.

Figure 11A:
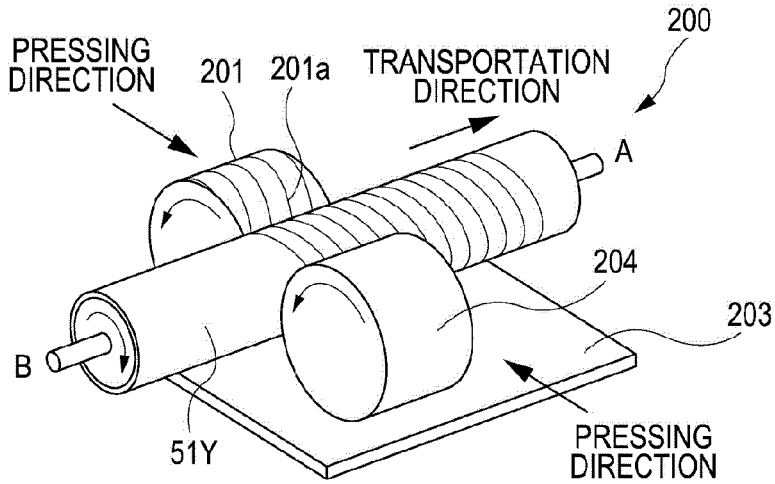
FIGS. 11A and 11B are views showing a rolling process in a method of manufacturing a development roller according to Embodiment 1 of the invention.
Figure 11B:
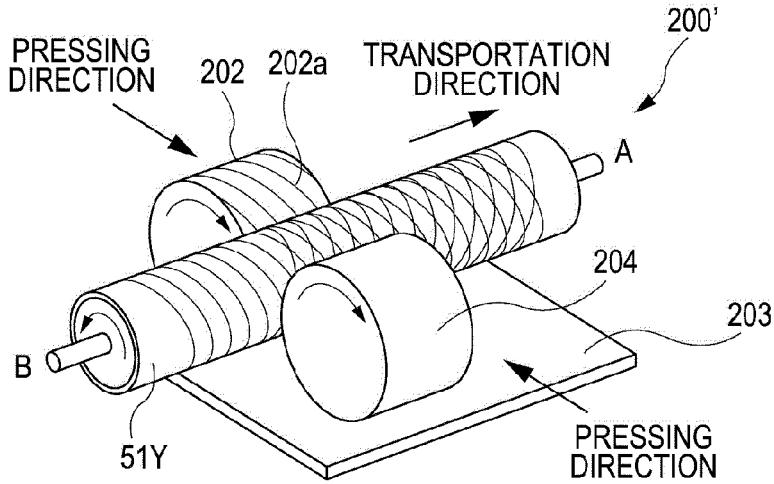

FIGS. 11A and 11B are views showing the rolling process for manufacturing the development roller 51Y to form the burrs 51*e* in the ridge lines of two sides facing any one of the axial direction of the development roller 51Y, according to Embodiment 1 of the invention.

A first rolling process of the rolling process of Embodiment 1 is performed by a rolling device 200 in which a first die 201 including a first inclined cutting edge 201*a* and a die 204 without a cutting edge are disposed to be opposed to each other on a guide stage 203. In the present embodiment, the inclined angle of the axial direction of the first inclined cutting edge 201*a* is set to 45° and the interval between grooves formed in the development roller 51Y is set to the same pitch. In the first rolling process, the first die 201 and the die 204 without the cutting edge are rotated in the counterclockwise direction as denoted by an arrow of FIG. 11A. The non-rolled development roller 51Y is being rotated in the clockwise direction opposed to the rotation direction of the first die 201 and the die 204 without the cutting edge from the end A out of both ends A and B, and is transported among the first die 201, the die 204 without the cutting edge and the guide stage 203. During rolling, working pressure is applied in a direction for pressing the non-rolled development roller 51Y to the first die 201 and the die 204 without the cutting edge.

Figure 12:
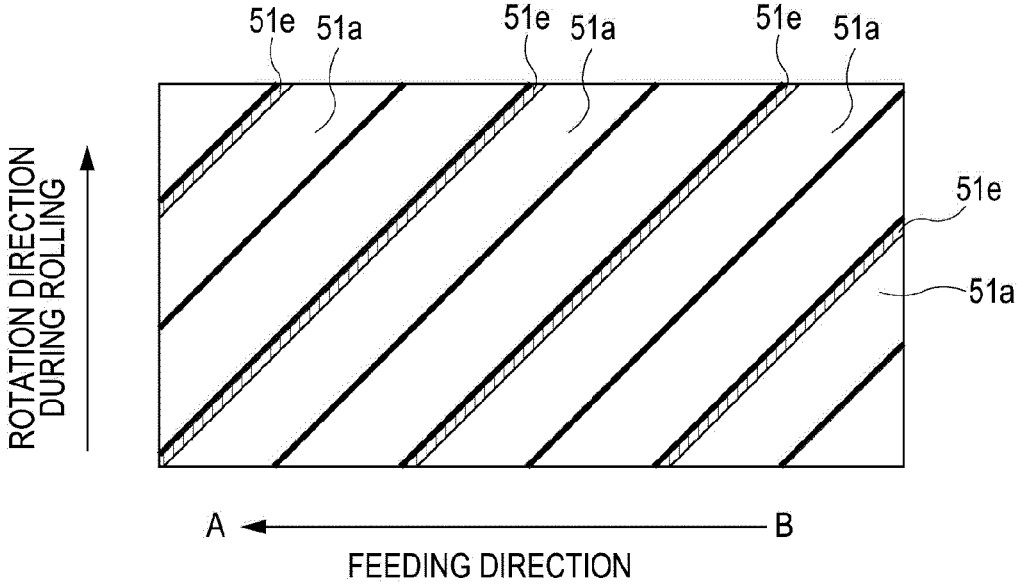
FIG. 12 is a view showing the state of first inclined grooves and burrs formed by a first rolling process.

As the result of the first rolling process, as shown in FIG. 12, the continuous spiraling first inclined grooves 51*a* are formed in the development roller 51Y. During the rolling of the first inclined grooves 51*a*, the burrs 51*e* are formed in the ridge lines of the upstream side of the rotation direction of the development roller 51Y of a non-rolled band-shaped portion and the upstream side of the feeding direction of the non-worked development roller 51Y (the backside of the transportation direction, that is, the side facing one side of the axial direction of the development roller 51Y).

A second rolling process of the rolling process of Embodiment 1 uses a rolling device 200' different from the rolling device 200 used in the first rolling process. In the rolling device 200', a second die 202 including a second inclined cutting edge 202*a* inclined in the opposite direction of the first inclined cutting edge 201*a* and a die 204 without a cutting edge are disposed to be opposed to each other on a guide stage 203. In the present embodiment, the inclined angle of the axial direction of the second inclined cutting edge 202*a* is set to 45° and the interval between grooves formed in the development roller 51Y is set to the same pitch.

In the second rolling process, the second die 202 and the die 204 without the cutting edge are rotated in the clockwise direction opposed to the direction of the first rolling process as denoted by an arrow of FIG. 11B. The non-rolled development roller 51Y in which the first inclined grooves 51*a* are formed is rotated in the counterclockwise direction opposed to the rotation direction of the second die 202 and the die 204 without the cutting edge from the end A out of both ends A and B and is transported among the second die 202, the die 204 without the cutting edge and the guide stage 203 of the rolling device 200'. During rolling, working pressure is applied in a direction for pressing the non-rolled development roller 51Y to the second die 202 and the die 204 without the cutting edge.

Figure 13:
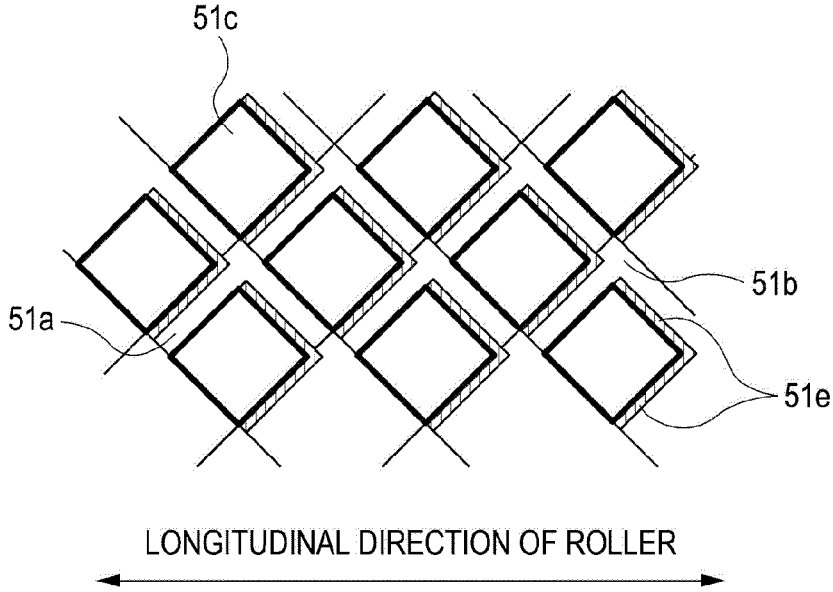
FIG. 13 is a view showing a development roller surface and burr state when a second rolling process is completed.

As the result of the second rolling process, as shown in FIG. 13, the second inclined grooves 51*b* crossing the continuous spiraling first inclined grooves 51*a* at a crossing angle of 90° are formed in the development roller 51Y. The burrs 51*e* are formed in the ridge lines of two sides facing one side (right side) of the axial direction of the development roller 51Y of the square convex portions 51*c* surrounded by the first inclined grooves 51*a* and the second inclined grooves 51*b*.

If the ridge lines of the two sides of the convex portions 51*c* in which the burrs 51*e* are formed are located on the other side (left side) of the development roller 51Y, in the first rolling process, the rotation direction of the first die 202 and the die 204 without the cutting edge and the rotation direction of the non-rolled development roller 51Y are set to the opposite direction of FIG. 11A such that the first inclined grooves 51*a* are formed. In the second rolling process, the rotation direction of the second die 202 and the die 204 without the cutting edge and the rotation direction of the development roller 51Y in which the first inclined grooves 51*a* are formed are set to the opposite direction of FIG. 11B such that the second inclined grooves 51*a* are formed. As a result, the burrs 51*e* are formed in the ridge lines of the two sides facing the other side (left side) of the axial direction of the development roller 51Y of the square convex portion 51*c* surrounded by the first inclined grooves 51*a* and the second inclined grooves 51*b*.

Although two rolling devices 200 and 200' are used in the rolling process of Embodiment 1, the rolling device 200 used in the first rolling process may be used by replacing the first die 201 with the second die 202 in the second rolling process. Although the crossing angle between the first inclined grooves 51*a* and the second inclined grooves 51*b* is 90° in the first embodiment, the crossing angle may be the other angles.

Figure 14A:
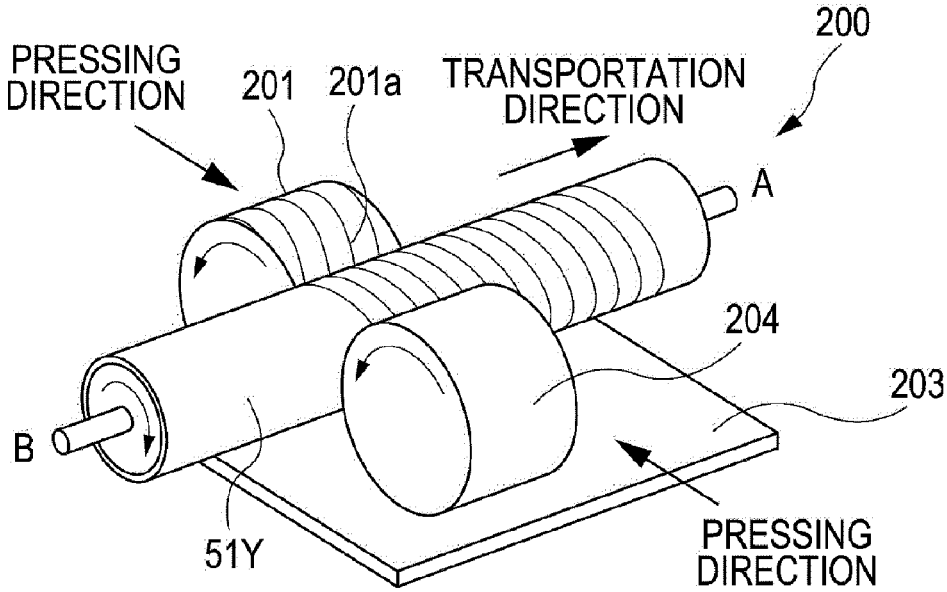
FIGS. 14A and 14B are views showing a rolling process in a method of manufacturing a development roller according to Embodiment 2 of the invention.
Figure 14B:
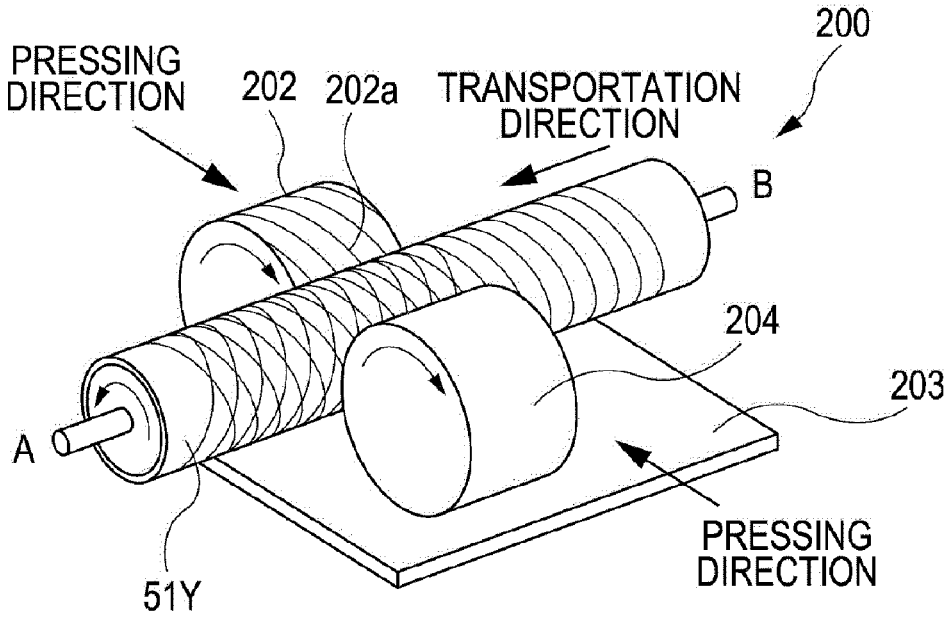

FIGS. 14A and 14B are views showing the rolling process to form the burrs 51*e* in the ridge lines of two sides facing any one of the axial direction of the development roller 51Y, according to of Embodiment 2 of the invention.

A first rolling process of the rolling process of Embodiment 2 is performed by a rolling device 200 in which a first die 201 including a first inclined cutting edge 201*a* and a die 204 without a cutting edge are disposed to be opposed to each other on a guide stage 203. In the present embodiment, the inclined angle of the axial direction of the first inclined cutting edge 201*a* is set to 45° and the interval between grooves formed in the development roller 51Y is set to the same pitch. In the first rolling process, the first die 201 and the die 204 without the cutting edge are rotated in the counterclockwise direction as denoted by an arrow of FIG. 14A. The non-rolled development roller 51Y is rotated in the clockwise direction opposed to the rotation direction of the first die 201 and the die 204 without the cutting edge from the end A out of both ends A and B, and is transported from one side of the rolling device 200 among the first die 201, the die 204 without the cutting edge and the guide stage 203. During rolling, working pressure is applied in a direction for pressing the non-rolled development roller 51Y to the first die 201 and the die 204 without the cutting edge.

As the result of the first rolling process, similar to the rolling process of Embodiment 1, as shown in FIG. 12, the continuous spiraling first inclined grooves 51*a* are formed in the development roller 51Y. During the rolling of the first inclined grooves 51*a*, the burrs 51*e* are formed in the ridge lines of the upstream side of the rotation direction of the development roller 51Y of a non-rolled band-shaped portion and the upstream side of the feeding direction of the non-worked development roller 51Y (the backside of the transportation direction, that is, the side facing one side of the axial direction of the development roller 51Y).

In a second rolling process of the rolling process of Embodiment 2, the first die 201 of the rolling device 200 used in the first rolling process is replaced with a second die 202 including a second inclined cutting edge 202*a* inclined in a direction opposed to the direction of the first inclined cutting edge 201*a*. The inclined angle of the axial direction of the second inclined cutting edge 202*a* is set to 45° and the interval between grooves formed in the development roller 51Y is set to the same pitch. In the second rolling process, the second die 202 and the die 204 without the cutting edge are rotated in the clockwise direction opposed to the direction of the first rolling process as denoted by an arrow of FIG. 14B. The development roller 51Y in which the first inclined grooves 51*a* are formed is transported from the other side opposed to one side of the rolling device 200, in which the non-rolled development roller 51Y starts to be rolled in the first rolling process, in a state where the end A out of both ends A and B is at the front. The development roller 51Y is rotated in the counter-clockwise direction opposed to the rotation direction of the second die 202 and the die 204 without the cutting edge. During rolling, working pressure is applied in a direction for pressing the non-rolled development roller 51Y to the second die 202 and the die 204 without the cutting edge.

As the result of the second rolling process, similar to the rolling process of Embodiment 1, as shown in FIG. 13, the second inclined grooves 51*b* crossing the continuous spiraling first inclined grooves 51*a* at a crossing angle of 90° are formed in the development roller 51Y. The burrs 51*e* are formed in the ridge lines of two sides facing one side (right side) of the axial direction of the development roller 51Y of the square convex portions 51*c* surrounded by the first inclined grooves 51*a* and the second inclined grooves 51*b*. Although the crossing angle between the first inclined grooves 51*a* and the second inclined grooves 51*b* is 90° in the rolling process of the Embodiment 2, the crossing angle may be the other angles. Even in the rolling process of Embodiment 2, similar to the rolling process of Embodiment 1, the ridge lines of two sides of the convex portions 51*c* in which the burrs 51*e* are formed may be formed on the other side (left side) of the development roller 51Y. The rolling process of Embodiment 3 may use one rolling device 200 and is suitable for the case where the length of the rolling process line is restricted.

Figure 15:
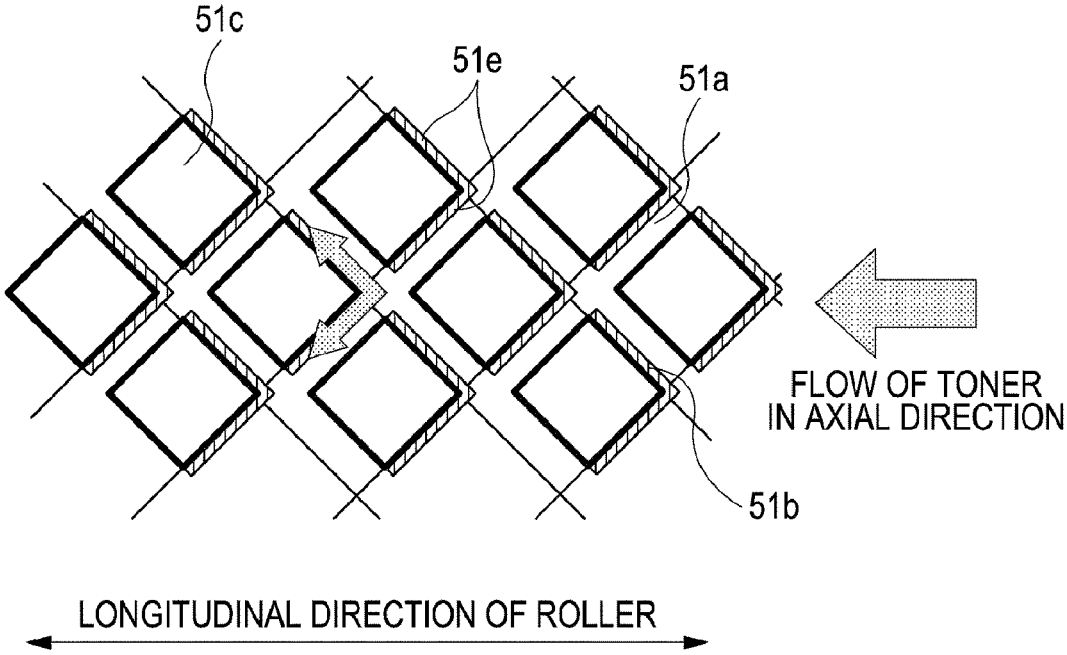
FIG. 15 is a view showing the operation and the effect of the toner transportation force due to formation of burrs in the ridge lines of the two sides of the development roller in one side of the axial direction.

FIG. 15 is a view showing the flow of the toner when the transportation force by the feed roller of the first embodiment or the second embodiment is generated in the development roller 51Y in which the burrs 51*e* are formed in the ridge lines of two sides facing one side (right side or left side) of the axial direction of the development roller 51Y formed in the rolling process of Embodiment 1 or 2.

By the toner transportation force in the axial direction generated in the development roller 51Y, the toner, which is retained without being circulated in the shade portions of the burrs 51*e* of two sides formed on the side opposed to the transportation force, is pushed out and circulated by the introduction of the toner with the transportation force into the shade portions of the burrs 51*e*. Since the burrs 51*e* are formed in two sides opposed to the toner transportation force, the toner retained in the burrs 51*e* receives the benefit of the circulation of the toner due to the transportation force, the amount of toner being retained on the development roller 51Y is reduced, and thus the occurrence of colored filming is suppressed.

The entire disclosure of Japanese Patent Application No. 2008-315585, filed Dec. 11, 2008 is expressly incorporated by reference herein.

What is claimed is:

1. A development device comprising:

a development roller in which continuous spiraling inclined grooves having different inclinations with respect to an axial direction are formed so as to cross each other; and a feed roller which is in contact with the development roller and feeds toner to the development roller, wherein transportation force, which is used for transporting the toner on the development roller from one side to the other side in the axial direction of the development roller, is generated by the rotation of the feed roller, wherein burrs are formed in ridge lines of two sides of rectangular convex portions surrounded by the crossing inclined grooves, and wherein the two sides of the convex portions, in which the burrs are formed, are a side opposed to the direction of the toner transportation force.

2. The development device according to claim 1, wherein the inclined grooves are formed by rolling.

3. The development device according to claim 1, wherein the feed roller is a brush roller obtained by spirally winding a basic material having a plurality of brush bristles transplanted thereon on the outer circumference of a core, and the transportation force, which is used for transporting the toner from one side to the other side of the axial direction of the development roller, is generated by a direction of a winding seam formed by the winding of the brush roller.

4. The development device according to claim 3, wherein a circumferential velocity of the feed roller is more than that of the development roller.

5. The development device according to claim 1, wherein an axial direction of the feed roller is disposed to be skewed with respect to the axial direction of the development roller, and the transportation force, which is used for transporting the toner from one side to the other side of the axial direction of the development roller, is generated by the rotation of the feed roller.

6. The development device according to claim 5, wherein the feed roller is formed of an elastic foam material.

7. The development device according to claim 5, wherein the development roller and the feed roller are driven by gears.

8. The development device according to claim 5, wherein the position of a bearing of the feed roller is able to be changed.

9. The development device according to claim 5, wherein a circumferential velocity of the feed roller is more than that of the development roller.

10. An image forming apparatus comprising:

a latent image carrier on which an electrostatic latent image is formed;

a development device which develops the electrostatic latent image using toner and develops a toner image on the latent image carrier; and a transfer device which transfers the toner image of the latent image carrier onto a transfer medium, wherein the development device is the development device according to claim 1.

* * * * *

UNITED STATES PATENT AND TRADEMARK OFFICE

CERTIFICATE OF CORRECTION

PATENT NO. : 7,965,965 B2
APPLICATION NO. : 12/620703
DATED : June 21, 2011
INVENTOR(S) : Maeda et al.

It is certified that error appears in the above-identified patent and that said Letters Patent is hereby corrected as shown below:

On the Face Page, in Field (74), under "Attorney, Agent or Firm", in Column 2, Line 1, delete "Maschoff Gilmore & Israeisen" and insert -- Maschoff Gilmore & Israelsen --, therefor.

Signed and Sealed this
Twenty-fourth Day of July, 2012

David J. Kappos

David J. Kappos
*Director of the United States Patent and Trademark Office*